US005893778A

United States Patent [19]

Mansutti

[11] Patent Number: 5,893,778

[45] Date of Patent: Apr. 13, 1999

[54] MODULAR CONNECTOR

[75] Inventor: Patrick Mansutti, Cergy, France

[73] Assignee: The Whitaker Corporation, Wilmington, Del.

[21] Appl. No.: 08/889,386

[22] Filed: Jul. 8, 1997

[30] Foreign Application Priority Data

Jul. 22, 1996 [EP] European Pat. Off. ..... 96401636

[51] Int. Cl.[6] ..... H01R 13/502

[52] U.S. Cl. ..... 439/701

[58] Field of Search ..... 439/594, 595, 439/599, 701, 717, 752

[56] References Cited

U.S. PATENT DOCUMENTS 4,753,614 6/1988 Weiner ..... 439/717

5,368,505 11/1994 Hoolhorst et al. ..... 439/701

FOREIGN PATENT DOCUMENTS 0 548 941 A1 6/1993 European Pat. Off. ..... H01R 13/514

2 246 247 1/1992 United Kingdom ..... H01R 13/40

*Primary Examiner*—Khiem Nguyen

*Attorney, Agent, or Firm*—Driscoll A. Nina

[57] ABSTRACT

Stackable connector modules comprise adjacent interleaving wall portions. The interleaving wall portions enable the modules to be stacked together at a small pitch, because only one wall thickness separates the modules. The wall portions are necessary for providing mechanical rigidity and electrical separation of rows of contacts in the cavities.

5 Claims, 3 Drawing Sheets

MODULAR CONNECTOR

BACKGROUND OF THE INVENTION

1. Field of the Invention

This invention relates to an electrical connector comprised of modules assembled together.

2. Description of the Prior Art

It is known to provide electrical connectors in separate modules that are assembled together into a single assembly for mating with a complementary connector. A module may, for example, comprise an insulative housing having a row of terminal receiving cavities for receiving electrical terminals connected to conducting wires. Such modules, whether identical or similar, are then stackable together and usually mounted in a shell housing that encapsulates and secures the plurality of assembled connector modules. A connector with a plurality of rows of and columns is thus formed. One of the advantages of modular design is, for example, when the conducting wires terminate to different modules that are connected to different harnesses and can only be assembled together when the harnesses are assembled in the device or apparatus for which they are destined. The latter is typical in the automotive industry. By preparing separate modules, conducting wires can be terminated to terminals and premounted in the modules in an automated procedure, and then simply assembled together in a shell housing upon final assembly.

One of the problems of providing connector modules as opposed to a single connector block is the increase in volume. For example a single row module is provided top and bottom walls requiring a minimum thickness in order to provide sufficient mechanical rigidity. When stacking modules together, the wall thickness separating terminals is thus doubled. When producing a single (non-modular) connector with a plurality of rows and columns, the walls can be made thinner and therefore a more compact pitch between terminals can be achieved.

SUMMARY OF THE INVENTION

It is an object of this invention to provide a compact modular connector. It would be advantageous that such connector be provided in a cost effective manner.

Objects of this invention have been achieved by providing the connector according to claim 1. Advantageously, due to interleaving of the interengaging wall portions of adjacent modules, a compact modular connector is provided.

Further advantageous aspects of this invention will be apparent from the following description and the claims.

DETAILED DESCRIPTION OF THE PREFERRED EMBODIMENT

Figure 1:
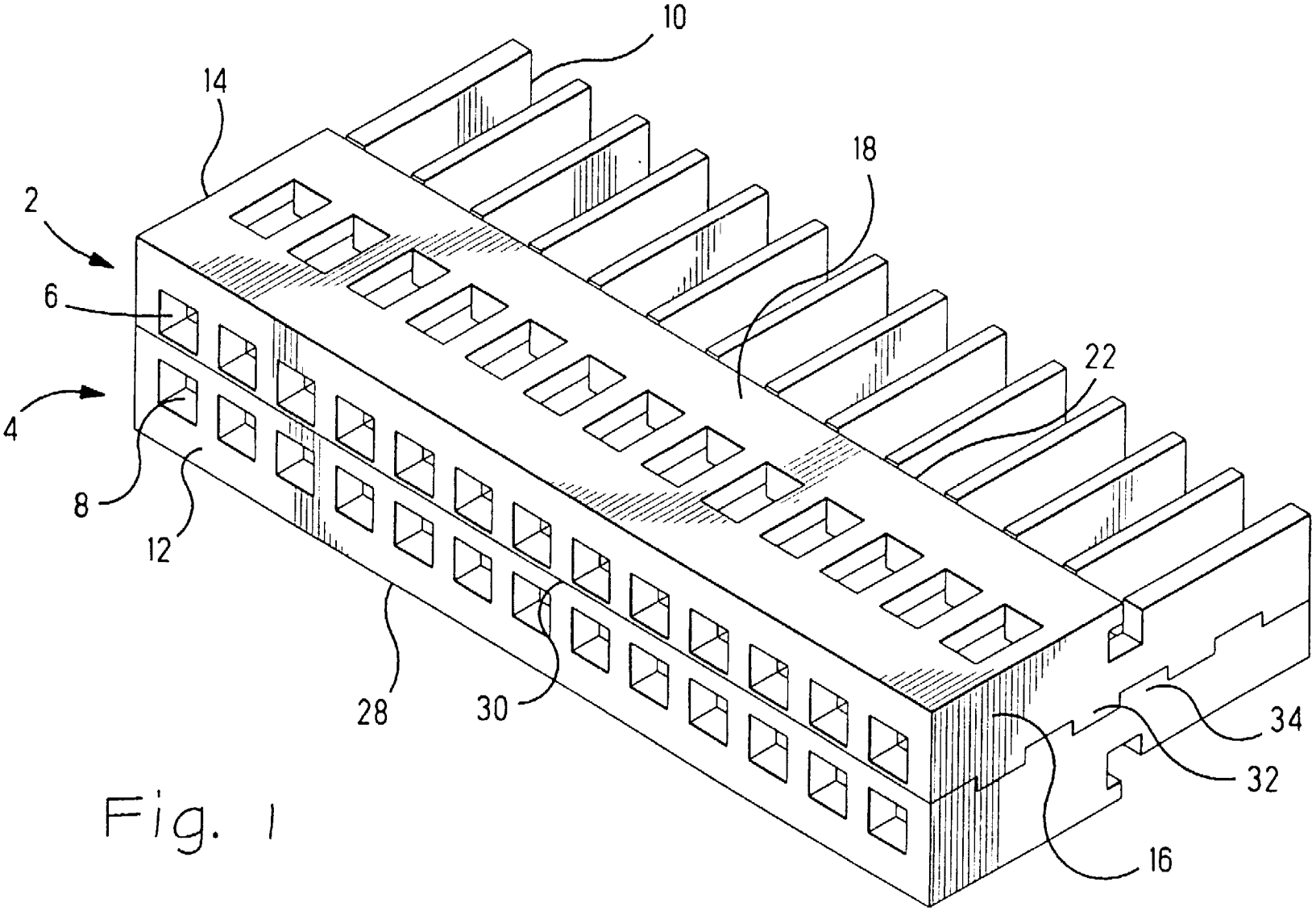
FIG. 1 is an isometric view of two connector modules stacked together.

Referring to FIG. 1, an electrical connector comprises a plurality of connector modules 2,4 received in a shell housing (not shown) that surrounds and secures the modules together. In the particular embodiment, each module 2,4 comprises a single row of terminal receiving cavities 6,8 respectively. Two modules 2,4 are shown stacked together in FIG. 1, but it would also be possible to imagine that a plurality of modules 2,4 could be stacked together by adapting the lower face of the lower module (as viewed from FIG. 1) to resemble the lower face of the upper module such that a plurality of modules could be stacked together.

The terminal receiving cavities 6,8 extend from a conducting wire receiving end 10 to a mating face 12, each of the cavities receiving from the mating face 10 electrical terminals 14 (see FIG. 2) therein. The row of cavities 6 is bounded at ends of the row by end walls 14,16, and on either side of the row by first and second walls 18,20 (see FIG. 1 in conjunction with FIG. 3).

Figure 2:
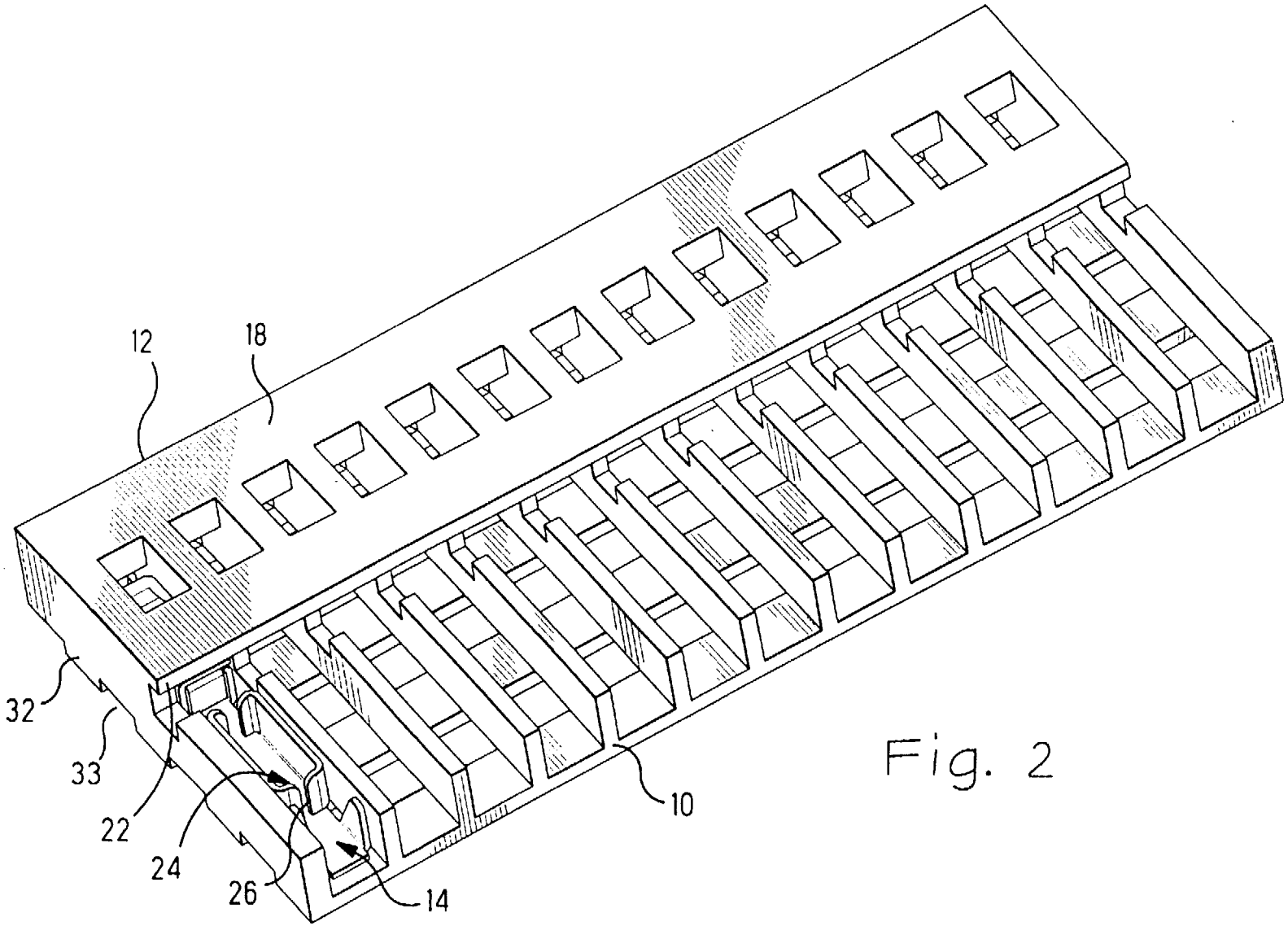
FIG. 2 is an isometric view of one of the modules of FIG. 1.

In the particular embodiment, the first wall 18 of the module 2 extends from the mating end 12 to an end 22 spaced from the terminal receiving end 10. As shown in FIG. 2, the electrical terminals 14 have insulation displacement contacting portions 24 having IDC slots 26 that receive insulated conducting wires (not shown) therein. The IDC slots 26 cut through the insulation of the wire and contact the inner conducting strands thereof. Due to the spacing of the end 22 of the first wall from the terminal receiving end 10 of the module, the terminal receiving cavities 6 are exposed at the position of the IDC portions 24 to enable conducting wires to be inserted into the IDC slots 26 when the terminals 14 are fully inserted in the cavities 6. The latter enables very cost effective automated assembly of terminals into the cavities and subsequent connection to conducting wires.

Figure 3:
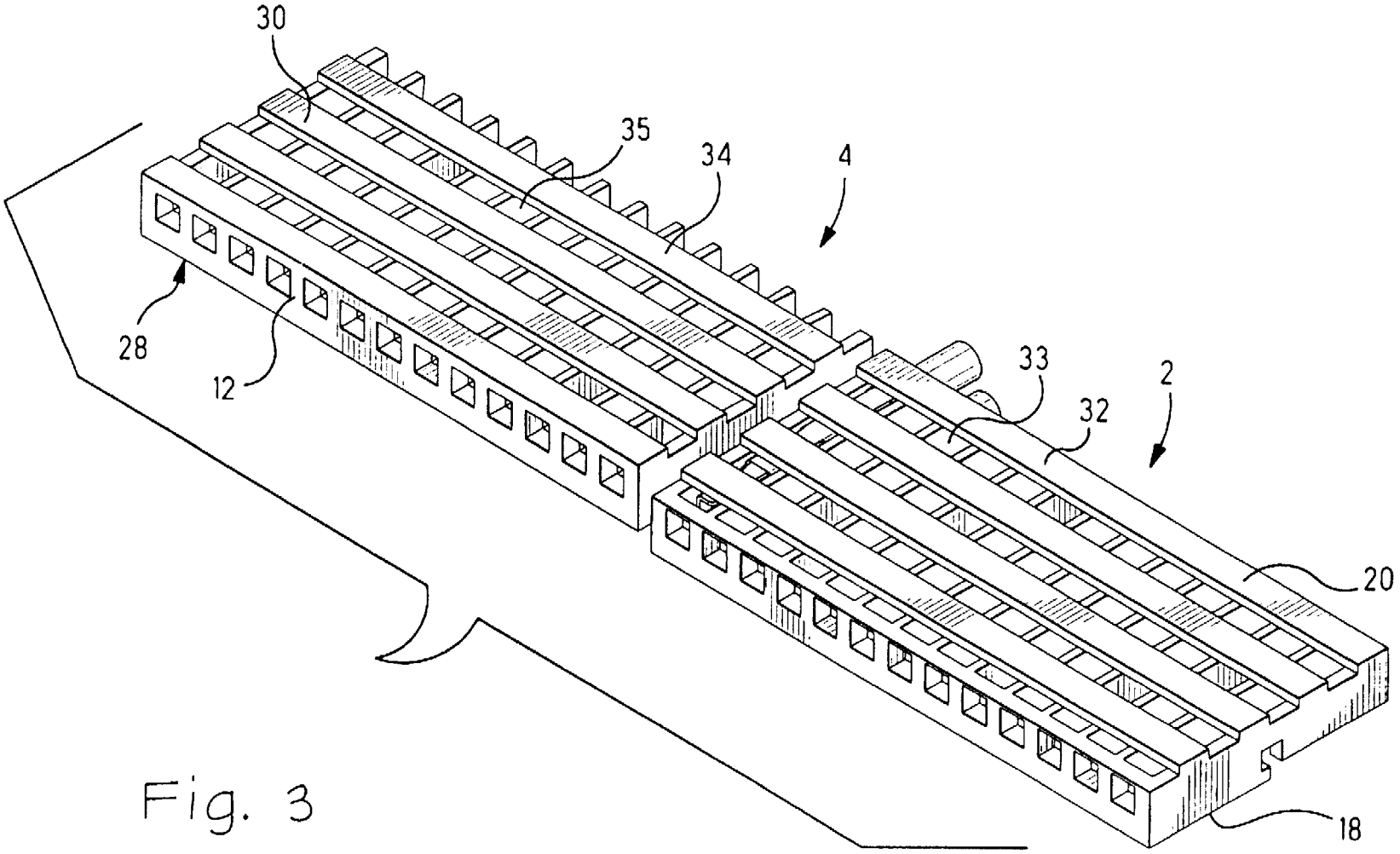
FIG. 3 is an isometric view of the two modules of FIG. 1 prior to stacking together.

In the embodiment of FIG. 1 where the connector comprises only 2 modules 2,4, the two modules can be formed as an integral part in the disposition shown in FIG. 3 where thin severable webs interconnect the modules. The second module 4 also comprises a first wall 28 and opposed second wall 30 (see FIGS. 1 and 3) on either side of the row of cavities 8. The first wall 28 of the second module 4 is similar in design to the first wall 18 of the first module 2, whereby conducting wires can be terminated to terminals in the same manner as previously described. By providing the two modules 4,2 interconnected by severable or breakable webs, conducting wires can be terminated to terminals inserted in the cavities from one side of both modules in an automated procedure. After termination, the modules are separated and then stacked together where the second surfaces 20,30 are placed against each other. It would also be possible to manufacture the first module 2 separately from the second module 4, terminating them to different harnesses, and effecting assembly on the device or apparatus for which the harnesses are destined. Termination of conducting wires to the terminals can also be effected once the modules are stacked together, because as shown in FIG. 1, the IDC sections 24 of terminals received in the cavities 6 and 8 of the two modules, are accessible from opposed sides of the connector. It would also be possible to provide such stackable modules with terminals that are crimped to the conducting wires and then inserted into the terminal receiving cavities, depending on the requirements.

Referring to FIGS. 1 and 3, the two modules 2,4 differ in their second walls 20,30. Both second walls 20,30 comprise a plurality of longitudinal wall portions 32,34 respectively extending in the direction of the rows (i.e. substantially parallel to the direction of the mating face 12 of the modules). The disposition of the wall portion 32,34 of the respective modules 2,4 are such that when the modules are stacked together, the wall portion 32,34 interleave as shown in FIG. 1. Between wall portions 34 or wall portions 32 of either module, are spaces 33,35 respectively. In this particular embodiment, these spaces 33,35 are such that the terminal receiving cavities 6.8 are exposed to the exterior of the connector modules through these second walls. These spaces are however filled up when the modules are stacked together by the complementary wall portions 32.34. By virtue of the latter construction, the stacked modules are only separated from each other by the thickness of one wall rather than two walls. The wall portions 32.34 can therefore be provided sufficiently thick to provide the requisite rigidity and stability of the connector modules. A particularly compact stacking of connector modules can thus be provided. An additional advantage is that the interleaving of the wall portions securely positions the stacked modules with respect to each other. As has been already mentioned, it is also possible to provide more than two stacked modules, by merely adapting the construction of the opposed first and second faces.

I claim:

1. An electrical connector comprising separate connector modules stackable together, each module comprising a row of terminal receiving cavities, the row of each module bounded on at least one side by a second wall where the second walls of adjacent modules stacked together are contiguous, characterized in that the second wall of a first one of the connector modules comprises alternating wall portions and spaces that interleave respectively with alternating spaces and wall portions of the second wall of a second one of the connector modules stacked to the first connector module such that the connector modules are separated substantially by a thickness of one said second wall.

2. The connector according to claim 1 wherein the wall portions extend substantially in a direction parallel to the terminal row.

3. The connector according to claim 1 wherein each connector module comprises only one row of terminal receiving cavities.

4. The connector according to claim 1 wherein the spaces between wall portions are such that the terminal receiving cavities are exposed to the exterior via the spaces when the modules are not stacked together.

5. The connector according to claim 1 wherein the connector comprises two modules, each module having a first wall opposed to their respective second walls and having an exposed portion allowing access for conducting wires to be terminated to IDC portions of terminals mounted in the terminal receiving cavities when the modules are stacked together.

* * * * *